US008393133B2

(12) United States Patent
Parmley et al.

(10) Patent No.: US 8,393,133 B2
(45) Date of Patent: Mar. 12, 2013

(54) PACKAGE WRAPPING MACHINE WITH ITEM IDENTIFIER BASED EXCEPTION TO DEFAULT WRAP SETTINGS

(75) Inventors: Steven M. Parmley, Troy, OH (US); Juan C. Guzman, Dayton, OH (US); Clare C. Dickey, Kettering, OH (US); Carla A. Monnier, Vandalia, OH (US)

(73) Assignee: Premark FEG L.L.C., Glenview, IL (US)

( * ) Notice: Subject to any disclaimer, the term of this patent is extended or adjusted under 35 U.S.C. 154(b) by 192 days.

(21) Appl. No.: 12/119,610

(22) Filed: May 13, 2008

(65) Prior Publication Data

US 2008/0295461 A1 Dec. 4, 2008

Related U.S. Application Data

(60) Provisional application No. 60/941,042, filed on May 31, 2007.

(51) Int. Cl.
*B65B 3/26* (2006.01)
*B65B 11/00* (2006.01)

(52) U.S. Cl. ..... 53/504; 53/461

(58) Field of Classification Search ..... 53/461, 53/52, 55, 58, 504, 502, 503
See application file for complete search history.

(56) References Cited

U.S. PATENT DOCUMENTS

| | | | | |
|---|---|---|---|---|
| 4,458,470 | A * | 7/1984 | Fine | 53/502 |
| 4,781,215 | A | 11/1988 | Mayhall, Jr. et al. | |
| 4,813,211 | A | 3/1989 | Treiber | |
| 4,825,626 | A | 5/1989 | Treiber | |
| 4,944,135 | A * | 7/1990 | Treiber | 53/502 |
| 4,958,479 | A | 9/1990 | Treiber | |
| 5,144,787 | A | 9/1992 | Whitby et al. | |
| 5,606,849 | A | 3/1997 | Bettenhausen | |
| 5,655,356 | A | 8/1997 | Ginestra et al. | |
| 5,713,185 | A | 2/1998 | Lindström et al. | |
| 5,718,100 | A | 2/1998 | Petty | |
| 5,943,844 | A | 8/1999 | Wilhelm et al. | |
| 6,109,007 | A | 8/2000 | Combs et al. | |
| 6,170,236 | B1 | 1/2001 | Whitby et al. | |
| 6,247,292 | B1 | 6/2001 | Whitby et al. | |
| 6,505,459 | B1 | 1/2003 | Ruohio et al. | |
| 6,658,820 | B2 | 12/2003 | Whitby et al. | |
| 6,729,357 | B2 | 5/2004 | Marsche | |
| 6,851,250 | B2 | 2/2005 | Whitby et al. | |
| 6,877,297 | B2 * | 4/2005 | Armington et al. | 53/502 |
| 6,938,397 | B2 | 9/2005 | Miller | |
| 6,955,029 | B2 * | 10/2005 | Palumbo | 53/469 |
| 7,530,210 | B2 * | 5/2009 | McGuinness, Jr. | 53/411 |
| 2003/0145560 | A1 * | 8/2003 | Melville | 53/459 |
| 2005/0126123 | A1 * | 6/2005 | Chase et al. | 53/415 |
| 2007/0051075 | A1 * | 3/2007 | Chiu Chen | 53/504 |

* cited by examiner

*Primary Examiner* — M. Alexandra Elve
*Assistant Examiner* — John Paradiso
(74) *Attorney, Agent, or Firm* — Thompson Hine LLP

(57) ABSTRACT

A machine for wrapping items to produce packages includes default settings which provide appropriate parameters for wrapping packages based on a ubiquitous feature of the item such as tray size. In addition, one or more exceptions to the default settings are included such that items of a given value for the ubiquitous feature which require special or unusual handling parameters will be detected and handled according to these different parameters. These parameters including exceptions are readily transferable between multiple wrapping machines. An autocalibration feature allows for specific differences in the tolerances and settings of different wrapping machines.

2 Claims, 4 Drawing Sheets

PACKAGE WRAPPING MACHINE WITH ITEM IDENTIFIER BASED EXCEPTION TO DEFAULT WRAP SETTINGS

CROSS REFERENCE TO RELATED APPLICATIONS

This application claims the benefit of U.S. Application No. 60/941,042, filed May 31, 2007, and herein incorporated by reference.

TECHNICAL FIELD

This application relates generally to packaging machines for wrapping film around trayed products, and more specifically to automatic identification and packaging of a variety of products requiring different wrap settings.

BACKGROUND

Packaging machines are frequently used to automatically wrap film about product, such as trayed food items. The packaging machines typically include a film gripper that grips and pulls the film from a roll of film, side clamps that grip the film, and folders that fold the film underneath the product. Various control systems and sensors may be employed, for example, to control operation of the gripper and to sense product location. The sensors may detect tray size and other tray characteristics, such as food height, lip height etc., and use the detected characteristics to select an appropriate "wrapbox" for the product. As used herein the term "wrapbox" refers to a set of predefined wrap parameters that will be used by the machine in wrapping a product that is identified to that wrapbox. For example, each tray size handled by the machine may include its own wrapbox, enabling the machine to achieve a more optimum wrap for that tray size.

In some circumstances it may be desirable to opt out of the predefined wrapbox that would normally be selected based upon the sensing system of the machine. It would also be desirable to be able to readily transfer predefined settings from one machine to another, particularly within a given store and/or store chain.

Due to variances in the manufacturing process, it would also be desirable to provide a machine capable of automatically taking such variances into account, thereby resulting in better consistency of wrap as between different machines.

Once the appropriate set of wrapping parameters have been determined with the use of one machine, it is desirable to be able to transfer this list of wrapboxes to other machines. However, in the prior art, the transferability of these parameters to other machines is limited. If the wrap profile needs to be moved from one machine to another, it requires sending multiple screen captures of the parameters to the thermal labels of the machine's label printer. These labels are then adhered to pages in a notebook or 3-ring binder and are hand-carried to the destination machine. These labels are now at risk of damage from heat, weather or aging conditions The parameters on the labels are then hand entered into the console of the wrapping machine, introducing possible errors as they are typed in one by one. This process could take up to 15 minutes. If multiple destinations are getting the timings, the labels will have to be photo copied or the loading will be done one machine at a time. It would be desirable to provide a method of convenient transfer of wrap parameter adjustments between machines through a process less subject to error as a result of age, heat, or weather than previously available.

SUMMARY

In one aspect, a package wrapping machine includes an infeed station at which trayed items to be wrapped are placed. A conveying system moves trayed items into the machine and to a wrapping station where film is manipulated to wrap the trayed items. A sensor arrangement detects trayed items moved by the conveying system. A controller is associated with the sensor arrangement and operates to identify tray dimensions based upon outputs from the sensor arrangement. The controller normally selects a wrapbox associated with the identified tray dimensions, regardless of identity of the food product being wrapped. However, the controller includes an exception function that considers the item identifier for the item being wrapped (e.g., a PLU number input by the machine operator) and associates a specific wrapbox with that item identifier so that certain food products may be treated in a different manner.

In one implementation the exception function is implemented by including in each wrapbox an item identifier field (e.g., PLU number). For those wrapboxes having settings that are not dependent upon the food product being wrapped, the item identifier field is simply set to zero and the controller interprets the zero as a match to any identifier that is input for the tray being wrapped. To initiate an exception operation, an actual nonzero identifier is input into the item identifier field for a wrapbox, and the controller then requires an exact match of the identifier in order to select that wrapbox.

In another aspect, a package wrapping machine includes an infeed station at which trayed items to be wrapped are placed. A conveying system moves trayed items into the machine and to a wrapping station where film is manipulated to wrap the trayed items. A sensor arrangement detects trayed items moved by the conveying system. A controller is associated with the sensor arrangement and operates to control the wrap process based upon outputs from the sensor arrangement. The controller also includes an automated machine calibration sequence that can be initiated via a user interface of the machine. The calibration sequences causes one or more of the machine mechanisms to run through a calibration operation from which data can be stored and taken into account (e.g., referred to) during subsequent wrap operations. The stored data may be indicative of variations in the specific machine from a predefined, expected norm.

In another aspect, a method is provided for distributing wrap timing parameters for package wrapping machines that include an infeed station, a conveying system for moving trayed items into the machine to a wrapping station, a sensor arrangement for detecting trayed items moved by the conveying system, and a controller for controlling the wrap process. The controller is configured to permit wrap parameters to be edited via the user interface, downloaded to an external removable thumb drive or, in some cases, communicated by the machine to a remote computer device (e.g., wirelessly to a hand-held device or via a hard-wired connection to a store computer). The wrap parameters can then be readily uploaded to other wrapping machines (e.g., by connecting the thumb drive to the other machine, having the hand-held wirelessly download to the other machines or having the store computer distribute the parameters to the other machines).

DETAILED DESCRIPTION

Figure 1:
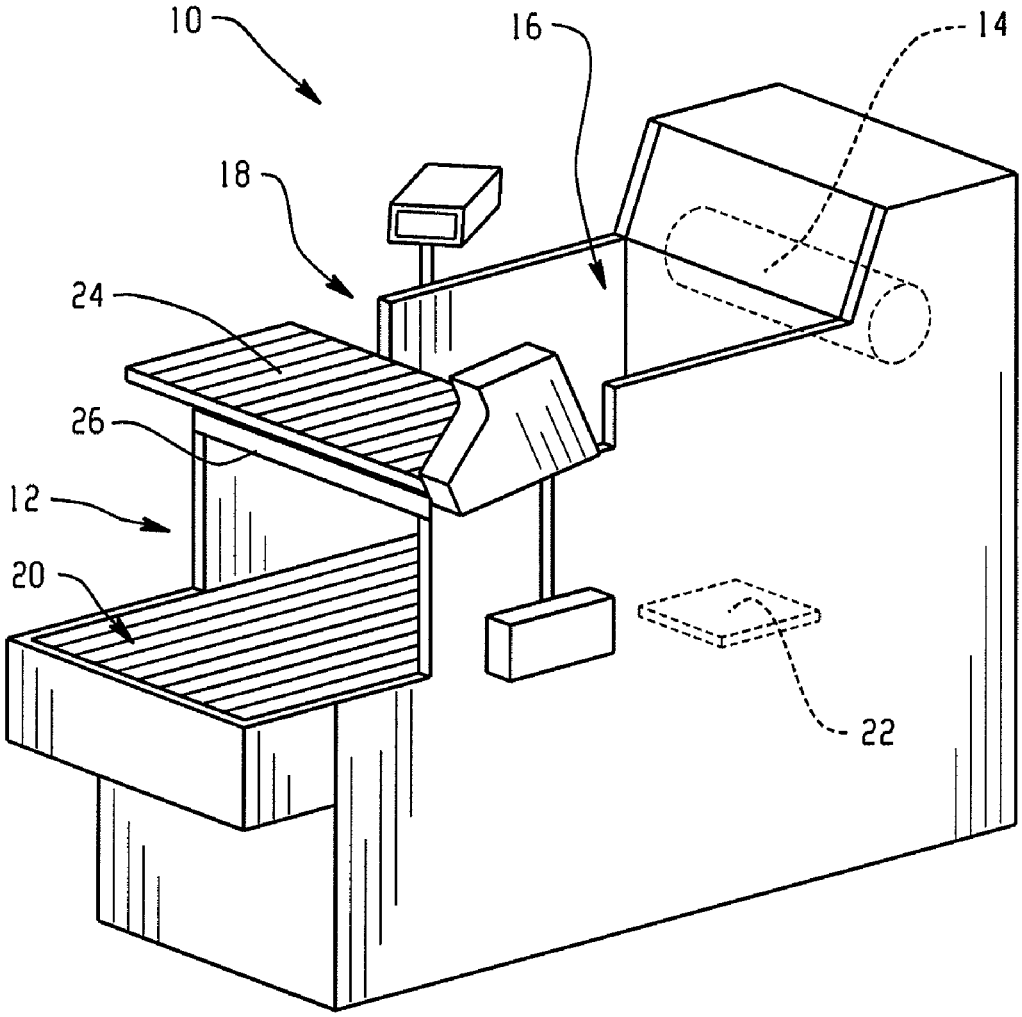
FIG. 1 is a side, perspective view of an embodiment of a package wrapping machine.

Referring to FIG. 1, a package wrapping machine 10 includes an in-feed portion 12 at which a product such as a trayed food item can be introduced to the machine 10, a wrap station 16 at which the product can be wrapped, e.g., by a wrap film such as a food contact grade film, and an out-feed portion 18 at which the wrapped product can be accessed to remove the product from the machine 10. The wrap station 16 includes an adjacent support for holding rolled film 14 and mechanisms (e.g., film grippers and underfold plates) for manipulating the film during a packaging operation. The support is located to permit film to be drawn off the roll 14 and into the wrapping station and a film grip assembly (not shown) is used for gripping at least one edge of film during at least part of a packaging operation.

More specifically, and as described in U.S. Pat. No. 6,851,250, a package is fed into the machine at an infeed station 12 and is moved rearward by a conveying system 20 to an elevator. The infeed station may include a weighing mechanism and the conveying system may be adjustable to center the package on the elevator.

A raised position of the elevator at least partially defines the wrap station 16. Before or when the package reaches the wrap station, a film gripper and side-clamps cooperate to draw an appropriate amount of film from a source roll out over the wrap station and to stretch the film in a desired manner. The amount of drawn film is determined by package size. The elevator 22 then moves the package up through a plane of the stretched film and the film is wrapped around the package by front, rear and side folding members. The wrapped package is moved onto a heat sealing conveyor 24 that receives and seals the wrapped film at the bottom of the package. Other wrapping machine variations having different wrapping station configurations could also be utilized.

Figure 2:
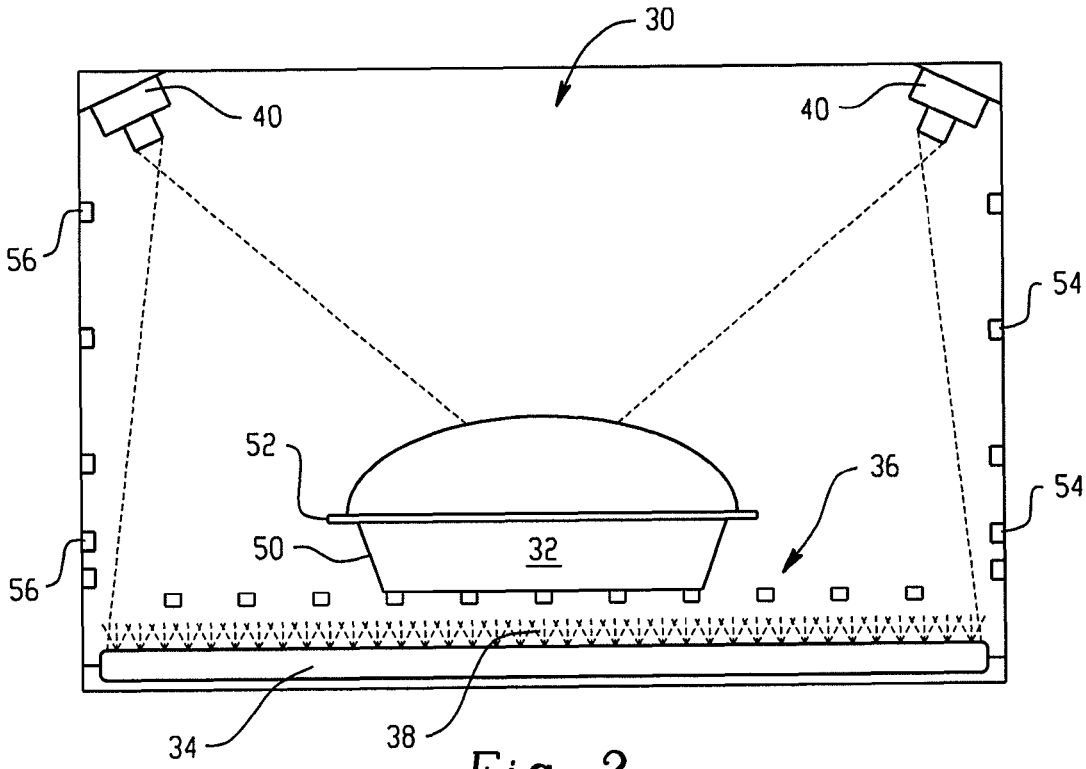
FIG. 2 is a schematic front elevation of a trayed item moving through a package size and position sensor arrangement of the machine of claim 1.
Figure 3:
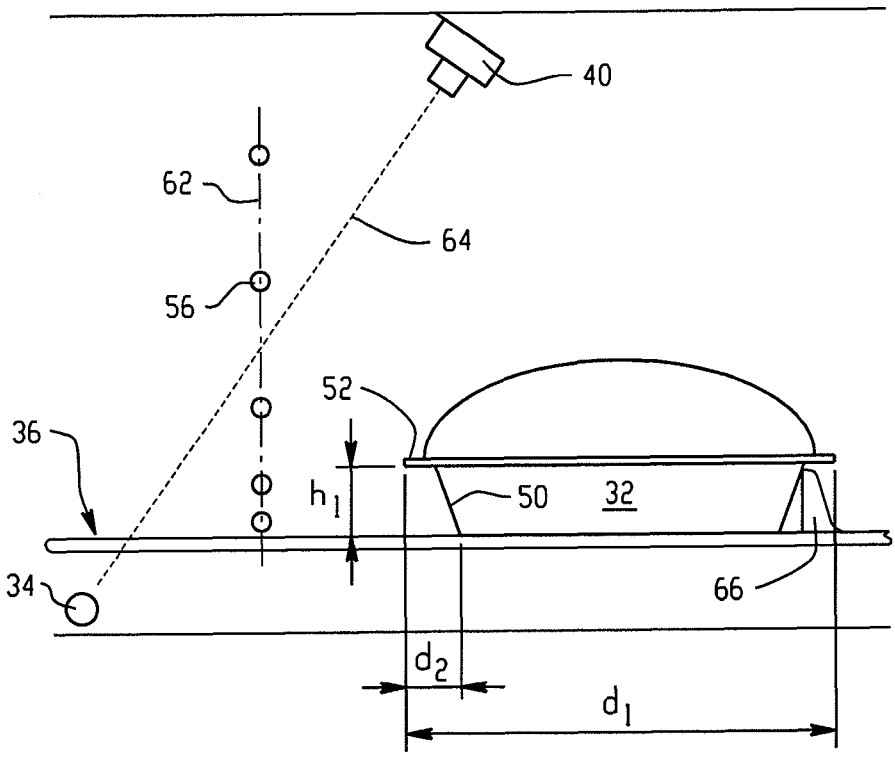
FIG. 3 is a schematic side elevation of FIG. 2.

Referring now to FIGS. 2 and 3, an exemplary package size and position sensor arrangement 30 located along the infeed conveying system is shown, where direction of travel of the trayed item 32 is into the page. The arrangement 30 may be positioned proximate to that portion 26 (FIG. 1) of the machine housing into which items are conveyed. The size and position sensor arrangement of FIG. 2 includes a light source 34 mounted below the conveyor 36 (shown as a series of spaced apart, narrow conveyor belts that permit light to flow upward through the conveyor. The light source may be, for example, an elongated light bulb that has been coated such that light 38 from the bulb escapes only upward and toward a pair of spaced apart cameras 40. The cameras 40 may, by way of example, be line scan cameras that are arranged with overlapping fields of vision. The cameras and light source create a light plane through which the trayed item 32 passes when moving toward the elevator.

As shown in FIG. 3, where movement of the trayed item 32 is right to left, in one example the height detection plane 62 is substantially vertical and the width detection plane 64 is angled, crossing the height detection plane 62. The trayed item 32 may typically be moved by a pusher paddle 66 associated with the conveyor. The front lip of a trayed item 32 will typically cross, and be detected by, the sensors of the height detection plane, enabling the length (i.e., dimension dl in the direction of right to left travel in FIG. 3) of the trayed item 32 to be determined because the position of the paddle 66 is known. In a case where a tray lip 52 is at a height such that it is pushed by the paddle 66, the length dimension is simply the distance of the paddle from the height detection plane 62 at the time the lip 52 of the trayed item 32 is detected in the plane 62. Where the tray lip 52 is at a height above the height of the paddle 66, then the actual length dl of the trayed item 32 (i.e. from lip edge to lip edge) will be slightly greater than the distance of the paddle 66 from the plane 62. The sensor arrangement may account for this difference by using the detection plane to determine a profile of the tray 50.

Figure 4:
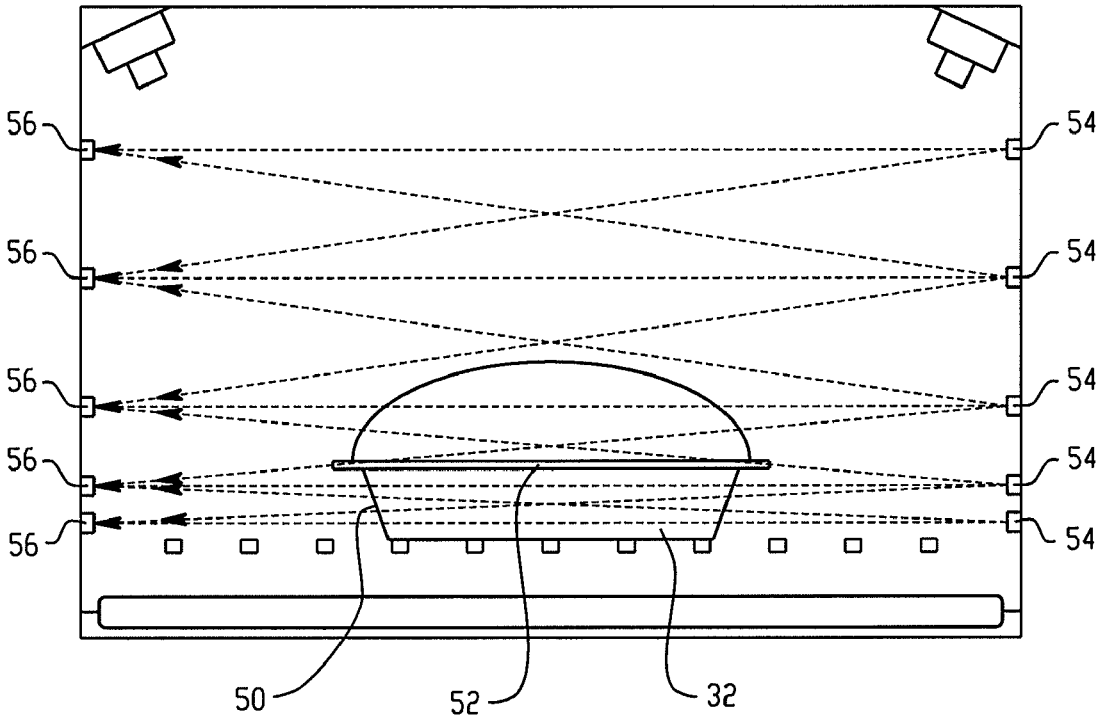
FIG. 4 is a schematic front elevation detailing light sensor and detector cooperation.

Referring to FIG. 4, where travel direction of the trayed item 32 is again into the page, each light emitter 54 outputs a field of light that tends to impinge upon the light sensor 56 directly across from it, as well as the light sensors immediately above and below such light sensor.

Figure 5:
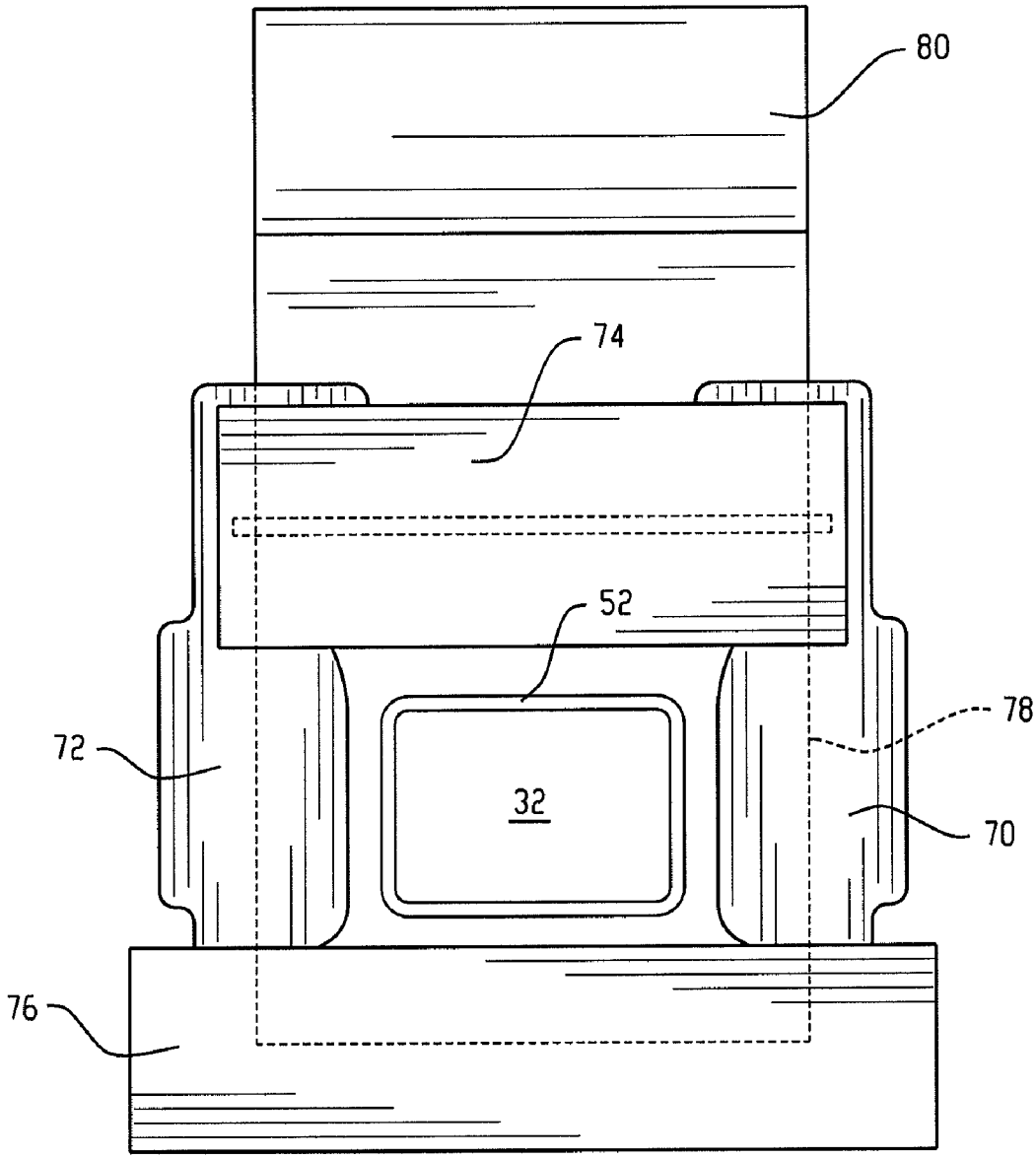
FIG. 5 is a top schematic view of a trayed item moving upward through film with underfolders moved into position to frame the trayed item.

Package dimension and position determinations can be used to control various wrap parameters of the machine. A wrapping machine may include a controller that uses the determinations to specify a wrapbox for a given trayed item, where the wrapbox may identify a specific tray size. Trays of the same family have the same width and length dimensions, but have different tray heights. Thus, the lip height determination, h1, can be used to assure that the proper tray size is selected. This result can be achieved by using the tray length and width determinations to identify the correct tray family, and then comparing the lip height to certain lip height windows associated with the tray sizes making up that tray family. By selecting the proper tray size, other wrapping parameters can be modified to achieve a better wrap for that tray size. For example, wrap parameters such as prepositioning of the film underfolders (see side underfolders 70 and 72, rear underfolder 74 and front underfolder 76 in FIG. 5) as the trayed item is moved upward through the plane of wrap film 78 that has been pulled from the film roll 80, and subsequent repositioning of the underfolders for beginning the wrap can be modified to achieve better wrap quality.

These wrap parameters are stored as a list in the controller, which receives data from the sensors and evaluates it. When the controller receives data associated with a new package, it compares the data to the first item on the list. If that item is a match, the corresponding wrapbox is used. If not, the controller compares the data to the second item on the list, until a match is found. The wrapbox corresponding to the matching item on the list is used.

By way of example, a machine might include a series of four wrapboxes corresponding to tray sizes 1014, 8s, 4s and 1s. The controller first identifies tray dimensions and compares them in sequence to the range of acceptable dimensions associated with each tray size. If the identified dimensions do not fall within those acceptable for the 1014, the controller compares them to those for the 8s, the 4s and 1s until a match is found. When a match is found, the wrapbox is selected and the parameters of that wrapbox are used for the wrapping operation.

When a specific item needs to be wrapped differently than other items using the same tray size, a unique parameter list is generated in the form of the exception wrapbox. The exception wrapbox uses a second identifier, such as a PLU number, to identify the specific item that should be wrapped using alternate parameters. The controller's list is structured such that the exception wrapbox is compared before the generic wrapbox of the same tray size. Both the tray size and the PLU number are compared, and only if both match exactly is the exception wrapbox used.

A machine that includes an exception wrapbox, might include a series of wrapboxes such as 1014, 8s, 4sFISH (PLU number 1234), 4s and 1s. The controller treats the exception wrapbox the same as the others, except for requiring that the PLU match exactly. Thus, if a 4s tray size for a product with a PLU of 0050 is being wrapped, the controller will run through the comparison process for 1014, 8s and 4sFISH without making a wrapbox selection. In the case of the 1014 and 8s, those wrapboxes are not selected because the tray dimensions do not match, and in the case of 4sFISH that wrapbox is not selected because the PLU does not match. The controller will therefore select the 4s wrapbox. On the other hand, if a 4s tray size with a PLU of 1234 is being wrapped, the controller will run through the comparison process for 1014 and 8s without making a wrapbox selection because the tray dimensions do not match. When the controller runs through the comparison to the 4sFISH wrapbox, the 4sFISH wrapbox will be selected because both the PLU and tray dimensions match.

As can be seen for the foregoing implementation, exception wrapboxes for any tray size should be ordered in the comparison queue ahead of any non-exception wrapboxes for that same size tray. Otherwise, the controller will select the non-exception wrapbox without ever reaching the exception wrapbox. However, it is recognized that other techniques could be implemented. For example, the first step could be for the controller to consider the PLU number of the item being wrapped, and then compare the tray dimensions for item being wrapped with only the wrapboxes having that exact PLU entered in the PLU field. If there is no match as a result, or if there are no such exception wrapboxes for the specific PLU number, then the controller runs through its normal comparison sequence to select a wrapbox.

An automatic wrapping machine may include a set of factory default settings for a typical machine specification. However, each machine may be mechanically manufactured with slight variances from those specifications. To account for the variances in the specifications, the machine can perform what is known as an auto calibration. This allows the machine to determine how far from the true specification that particular machine is and adjust its mechanism travels accordingly. Each of the mechanisms performs the auto calibration in sequence and records the pertinent data into data flash, where it resides until another calibration is initiated. The data is retrieved from data flash when motion is desired for a specific mechanism and the trajectories are altered using the data to allow for two things; first, to get maximum travel out of the mechanisms (e.g., farther underfold or longer film pull) and second, to limit the mechanisms from impacting the mechanical stops or each other.

In one embodiment, when the auto calibration process is initiated, it may be possible to select one or more individual mechanisms to be calibrated, or it may be possible to perform all calibrations during one auto calibration run. A numeric field is present to enter a test tray's length which is used during the calibration of the primary and camera systems.

Before the calibration sequence begins, each mechanism is "homed" to get the machine in a known state. Then each mechanism is moved slightly away from the home location, and then rehomed. This is done to guarantee that all the mechanisms are on the edge of the magnetic range of the home sensors. This places the machine in a state as if it were between packages during normal runtime. Each mechanism in the initiated sequence then performs its calibration. In one embodiment, a complete sequence of calibrations may include calibration of the primary intake, camera sensors, gripper, side clamps, rear underfolder, front underfolder, side underfolders, and pusher as described below.

The primary intake pushes the test tray (of known dimension) into the machine just far enough to go through the camera sensor system. The secondary intake is used to catch the tray and stop it for easy retrieval but otherwise does not need to be calibrated. While the tray is being pushed inwards, the cameras scan and send a measurement of length back to the primary which is aware of the test tray's actual length. A calculation is done to determine the error between the actual tray length and the measured tray length, and the true length of the intake is sent back to the camera system. The difference is also stored in flash for the primary to adjust its push trajectory. When in run mode, the camera now has a relationship between primary motion and distance from tripping the camera system, and can send back the corrected length of the tray being wrapped.

The gripper runs the "get film" trajectory but as it approaches the film selector slows and gently pushes into the bumpers, detects impact, relieves the force and takes a measurement of the distance from the home sensor to the film selector. The data (measured/sensed distance) is stored in flash and retrieved every time the "get film" trajectory is run. The data is used to gain the maximum amount of film in the gripper without actually applying force to the mechanical bumper stops.

The side clamps drive inward and the slide bearings contact the rubber bumper in the middle of the machine, detect impact, and take a measurement of the distance from home sensor to max clamp distance. The data (measured/sensed distance) is stored in flash and retrieved every time the side clamp "get film" trajectory is run. The data is used to limit the maximum amount of travel of the side clamps to prevent impact with the middle bumper.

The front underfolders drive inward and impact the inner bumpers, recording the data (measured/sensed distance of the move) into flash. Then they drive outward, recording the data (measured/sensed distance of the move) into flash. The former data is retrieved and used when performing a MiddleMove or Underfold operation. The latter data is retrieved and used when the package is being ejected out to the sealer belt, making sure that the discharge is free and clear of the covers of the machine.

The side underfolders, rear underfolders, and pusher all (independently) drive inwards until impact with the mechanical bumpers and record the maximum travel into flash. The data is retrieved and used to limit the maximum distance moved to prevent impact during run mode.

Once collected, the machine can use the autocalibration data to modify the trajectories of each of the wrap components to more accurately and tightly wrap products. Additionally, the data from multiple wrapping machines can be aggregated and used to help create the initial settings on newly manufactured devices. The data may be stored on the same system or in the same format as the wrapbox data, and may be transferred as explained below.

In one embodiment, the controller for the wrapping machine is found in a computer terminal which includes a user interface. The wrap parameters associated with each wrapbox can be transferred from the configured wrapping machine to its associated user interface in the form of one or more computer data files. Here it can be edited and transferred back, backed up for offsite storage, or saved to an external removable thumb drive. The timings on the thumb drive can be transferred via email or other similar electronic media and then copied onto a thumb drive at the destination machine. The destination thumb drive is inserted into the associated user interface and the timing can be stored to the new wrapping machine for use during wrapping operations.

This method moves the data to a non-volatile flash based drive in only a few seconds. These drives are typically not affected by usual heat, weather or aging conditions. The data can be duplicated and transmitted with relative ease, and the restoring of the data at multiple destinations (e.g., multiple wrapping machines at the same or different locations) can occur in parallel and only take a few seconds to complete, with confidence that the data has no errors relative to the original. In another embodiment, communications links between different machines could be provided (e.g., an Internet communications link) for transferring the settings data from one machine to another.

It is to be clearly understood that the above description is intended by way of illustration and example only and is not intended to be taken by way of limitation. The above description allows for many variations, and one skilled in the art will find myriad changes can be made within the spirit and scope of the claimed invention, which is intended to be limited only by the claims and operation of law.

What is claimed is:

1. A method for wrapping film around a trayed item while accounting for differences in type of item within the tray, comprising the steps of:

providing an automated wrapping machine with a controller and a film gripper, side clamp mechanisms, and film folder mechanisms;

the controller receiving data associated with a trayed item, including tray size data and item type data;

the controller matching the trayed item to a wrapping configuration of a set of wrapping configurations, including the steps of:

first comparing the data associated with the trayed item to a plurality of stored special wrapping configurations, each stored special wrapping configuration defining parameters for controlling the operation of the film gripper, side clamp mechanisms, and film folder mechanisms, each stored special wrapping configuration having an associated tray size identifier and an associated item type identifier, and matching the trayed item to one of the special wrapping configurations only if both (i) the tray size data matches the tray size identifier and (ii) the item type data matches the item type identifier, and thereafter, if no match is found among the stored special wrapping configurations, comparing data associated with the trayed item to a plurality of stored generic wrapping configurations, each stored generic wrapping configuration defining parameters for controlling the operation of the film gripper, side clamp mechanisms, and film folder mechanisms, each stored generic wrapping configuration having an associated tray size identifier and each stored generic wrapping configuration differing from any stored special wrapping configuration having the same tray size identifier, and matching the trayed item to one of the generic wrapping configurations only if the tray size data matches the tray size identifier of one generic wrapping configuration; and the machine wrapping the trayed item according to parameters specified by the matched wrapping configuration, wherein a wrap operation carried out according to the special wrapping configuration associated with a specific tray size identifier is different than a wrap operation carried out according to the generic wrapping configuration associated with the specific tray size identifier.

2. A method for wrapping stretch film around trayed items, comprising the steps of:

providing an automated wrapping machine with a controller that is programmed to set wrap parameters based upon tray size, the controller configured with stored default wrap parameters associated with a specific tray size;

identifying a particular item that requires wrap parameters that are different than the stored default wrap parameters normally set for the specific tray size in which the particular item is trayed;

configuring the controller with stored exception wrap parameters to be applied to the particular item and specific tray size, the stored exception wrap parameters differing from the stored default wrap parameters;

when wrapping trayed items in the specific tray size the controller effects wrapping of trayed items differently, according to whether the particular item is being wrapped, by determining whether a given trayed item in the specific tray size is the particular item and, if the given trayed item is not the particular item, the controller setting the wrap parameters to the stored default wrap parameters and effecting movement of a film gripper, a clamp and a folder to wrap stretch film around the given trayed item in accordance with the default wrap parameters;

if the given trayed item is the particular item, the controller setting the wrap parameters to the stored exception wrap parameters and effecting movement of the film gripper, the clamp and the folder to wrap stretch film around the given trayed item in accordance with the exception wrap parameters, where movement of at least one of the film gripper, clamp or folder differs as between the exception wrap parameters and the default wrap parameters so that the particular item is wrapped differently even though it is in the specific tray size.

* * * * *